US011708677B2

(12) United States Patent
Uluduz

(10) Patent No.: US 11,708,677 B2
(45) Date of Patent: Jul. 25, 2023

(54) PILE DRIVING SYSTEM

(71) Applicant: SADIKOGLU MAKINE INSAAT METAL PLASTIK KAGIT SAN. VE TIC. LTD. STI, Kocaeli (TR)

(72) Inventor: Ahmet Uluduz, Kocaeli (TR)

( * ) Notice: Subject to any disclaimer, the term of this patent is extended or adjusted under 35 U.S.C. 154(b) by 58 days.

(21) Appl. No.: 17/437,137

(22) PCT Filed: Apr. 4, 2019

(86) PCT No.: PCT/TR2019/050218

§ 371 (c)(1),
(2) Date: Sep. 8, 2021

(87) PCT Pub. No.: WO2020/190224

PCT Pub. Date: Sep. 24, 2020

(65) Prior Publication Data

US 2022/0170226 A1 Jun. 2, 2022

(30) Foreign Application Priority Data

Mar. 19, 2019 (TR) ..... 2019/04044

(51) Int. Cl.
*E02D 7/14* (2006.01)

(52) U.S. Cl.
CPC ..... *E02D 7/14* (2013.01)

(58) Field of Classification Search
CPC ..... E02D 7/14; E02D 7/18
See application file for complete search history.

(56) References Cited

U.S. PATENT DOCUMENTS

| | | | |
|---|---|---|---|
| 3,112,830 | A | 12/1963 | Podlesak |
| 5,284,375 | A | 2/1994 | Land, III |
| RE37,661 | E | 4/2002 | Raunisto |
| 2015/0275460 | A1 | 10/2015 | Audet |

FOREIGN PATENT DOCUMENTS

| | | | | |
|---|---|---|---|---|
| CN | 202390837 | U | | 8/2012 |
| CN | 209703503 | U | * | 11/2019 |
| EP | 2003252 | B1 | | 12/2009 |
| GB | 2358035 | B | | 2/2004 |
| JP | 5915126 | A | | 1/1984 |
| JP | 2010007439 | A | * | 1/2010 |
| WO | 2010119166 | A1 | | 10/2010 |
| WO | 2017018951 | A1 | | 2/2017 |

OTHER PUBLICATIONS

International Search Report for corresponding PCT/TR2019/050218, dated Feb. 10, 2020.
Written Opinion of the International Searching Authority for corresponding PCT/TR2019/050218, dated Feb. 10, 2020.

* cited by examiner

*Primary Examiner* — Sunil Singh

(57) ABSTRACT

A pile driving system having a body, a body connection arrangement connecting the body to construction equipment, two arms on the body at least one of which is movable, and a jaw at the end of the arms having a jaw recessed connection surface formed at the inner portion of the jaw, and at least one shoe having the shoe recessed connection surface creating a symmetric profile so as to overlap the jaw recessed connection surface and corresponding to it when attached.

9 Claims, 26 Drawing Sheets

PILE DRIVING SYSTEM

CROSS-REFERENCE TO RELATED U.S. APPLICATIONS

Not applicable.

STATEMENT REGARDING FEDERALLY SPONSORED RESEARCH AND DEVELOPMENT

Not applicable.

NAMES OF THE PARTIES TO A JOINT RESEARCH AGREEMENT

Not applicable.

REFERENCE TO AN APPENDIX SUBMITTED ON A COMPACT DISC

Not applicable.

BACKGROUND OF THE INVENTION

1. Field of the Invention

The present invention relates to a pile driving system for use in the construction equipment for driving piles into the ground. The invention particularly relates to a pile driving system comprising an easy assembly allowing different profiles to be driven into the ground.

2. Description of Related Art Including Information Disclosed Under 37 CFR 1.97 and 37 CFR 1.98.

It is a construction technology which has long been known and used in which cylindrical pipes having long or short diameters, a steel pile with a "Z"-shaped profile referred to as sheet pile or a pile having any other profile are driven into especially soil grounds or similar grounds. In order to drive the profiles with such shapes, the high-power equipment pushes the profile into the ground vertically (or with a definite angle) through vibration. In other words, driving process is performed by small (vibrating) sudden momentums. Huge forces which are applied with both a high impetus and a vibration allow the piles to be driven into the ground. The profile and strength of the pile to be driven, the magnitude of the force applied, and absolutely the amount of the vibration are also significant as well as the structure of the ground. When driving a pile, the construction equipment should tightly grip the pile and push the pile towards the ground by a strong force and vibration. This system is generally referred to as pile driving system.

The pile driving systems may be such that they are attached to the construction equipment and machinery which carry out this process only. What is important is the pushing and driving process of the pile into the ground with a strong force through vibration. To carry out this main process, the pile driving systems eventually provided significant developments. Some of these systems comprises hydraulic, some mechanic, and some comprises both hydraulic and mechanic systems.

There are many developments in the prior art concerning the pile driving system discussed in the invention. Some of these developments comprises the construction (arrangement structure) for clamping the profile and some of them comprises the constructions created for driving thereof. Considering clamping and then driving, but especially clamping arrangement of the pile, in general the pincers-like clamping arrangements or the clamping arrangements of mechanic or hydraulic forces between directly two arms has been found in the prior art. The clamping process is carried out by a hydraulic piston located at one side in most of the clamping arrangements functioning as the pincers with two arms arranged crosswise to each other.

In the prior art, a study on the pile driving arrangements is disclosed in the British Patent No. GB2358035. In said patent, there are two arms hinged at the middle portion, a hydraulic cylinder located between these two arms at the rear part, and the shoes comprising a pressure plate on the pressing portions at the ends of these two arms which is designed according to the profile of the pile to be driven. While these shoes may be used for adjusting or changing, in said patent, the pressure force (opening force) of the hydraulic piston created at the rear portion is transformed to the clamping force at the front portion. It is obvious that in order to allow this structure to resist to the created forces during the vibratory pressure, the pressure force (i.e. clamping force) should be high and resistant to the shear force of the connections therein.

In the prior art, another study on the pile driving arrangements is the U.S. Pat. No. 3,112,830. In said patent, two arms clamping the pile to be driven like an oval clamp and a hydraulic piston advancing these arms towards each other from the rear portion are seen.

Another patent which has been found in the prior art is the U.S. Pat. No. 5,284,375. Also in this patent, two arms are seen which are used for clamping (stabilizing) and driving the pile. While the main principle of these two arms is similar to the pincers as stated above, it is obvious that the hinged connection structure of the arms is highly different. The feature of the said design is that the arms are opened and closed by the hinge's movement being parallel to the axis between the arms and vertical to the opening direction of two arms. It is surprising that the shoe (machine component clamping the material to be driven) at the ends of these arms is a replaceable shoe.

Another patent which has been found in the prior art is the U.S. Pat. No. RE37661E. In said patent, an arrangement is disclosed being attached to a construction equipment and driving the profiles with sheet pile shapes by gripping. There are two arms or jaws clamping the profile to be driven in this arrangement. However, it is seen that one of these arms is movable and the other is stationary. The clamping is enabled by the pressure of the hydraulic cylinder such that the movable arm is hinged (located by a hinge) at the body of the arrangement in a place near middle portions.

In the prior art, an arrangement on the pile driving systems is disclosed in the European Patent No. EP2003252. In said patent, as is known from the prior art, there are two arm at least one of which is movable, a hydraulic piston creating the clamping force at the rear portion of these arms, and particularly the shoes at the end portion of the movable arm (or jaw) to clamp the object to be driven. It is claimed that it is possible to mount these shoes to the jaws by means of pins or screws and replace them, if desired. It is also claimed that it is possible to replace these shoes and to clamp and drive not only certain profiles but also different profiles such as circular and flat profiles. It is seen that the issue of replacing the shoes is mentioned in some patents as referred above, though it is not the main focus thereof. Moreover, it is obvious that the stationary holes and the fastening means (pins or screws) arranged in these stationary holes may facilitate the clamping during the replacement process. However, it is conceived that there will be a high shear force introduced into the fastening means (pins or screws) during the vibratory driving operation, thus there will be a need for too many holes and fastening means to provide resistance to these forces, which obstructs the possibility of easily assembling and disassembling, in addition to adding to the costs. The arrangement of the invention to be described below is known to be developed to overcome the problems of the prior art and especially of the design described in this patent.

Another patent of the prior art is an international patent no. WO2017018951 with priority in Turkey. In said patent, two arms arranged like pincers clamping the object to be driven, the hydraulic cylinder at the rear portion creating the clamping force towards the front portion, a toothed hinge structure formed near the middle portion of these arms, and the replaceable shoes formed at the end portions (jaws) of the arms are obviously seen.

In the prior art, it is obvious that there are other constructions or structures about the pile driving. Here, the documents on the state of the art being helpful for creating the invention. As an alternative to the prior art, an easily-replaceable and high strength clamping arrangement of the pile driving system will be described which constitutes the invention.

The object of the pile driving system of the invention is to obtain a movable jaw arrangement having shoes with an assembly construction which may easily be assembled and disassembled and comprising a connection surface resistant to high pressure forces.

BRIEF SUMMARY OF THE INVENTION

In the pile driving system of the invention, the connection surfaces between the jaws and the shoes attached to the jaws are also resistance fields that are created against the driving force (said force is assumed to be a vertical force against the ground, but it is not necessarily a vertical force always). Thus, there is a need for too many holes or attachment elements for the assembly of the shoes onto the jaws. As remembered, in the prior art, there is a need for a force facing the vertical forces to attach the shoe mounted onto the jaws and in order to tightly hold the shoes together with the unit to be driven. There used to be a need for a plurality of attachment elements so as to face the shear force to come in order to face these forces and also to allow the shoe to remain rigid on the jaw, however, this case is eliminated by the system of the invention.

In the pile driving system of the invention, a pincers system is used which clamps the pile to be driven by approaching each other and releasing the pile by moving away from each other and which is movable by a hydraulic piston from the rear according to the prior art. A mounting area is formed on the jaws at the end portions of the movable arms and the shoes which are designed according to the profile of the pile to be driven are arranged there. In order to easily locate these shoes, the protrusions and housings are created. A vertical pin is used in order to attach the shoes onto the jaws rigidly. An ordinary worker may easily replace the jaws at the end of the pile driving system by means of such a design.

By the pile driving system of the invention, a system was obtained which comprises shoes according to the profile structure of the piles and may be easily assembled and disassembled on the jaws at the end of the movable arms. Thus, not only an abutment surface between the jaw and the shoe but also a connection surface providing an easy assembly is obtained. Therefore, there is no need for a plurality of resistant mounting elements any more against the vertical driving force (pressure force). An attachment is provided without these mounting elements. A vertically-arranged mounting pin is sufficient to allow the connection of the shoe to the jaw. Therefore, there is no need any more for the complex systems and high strength attachment elements to attach and detach the shoe mounted to the jaw as is the case with the prior art.

Figure 1:
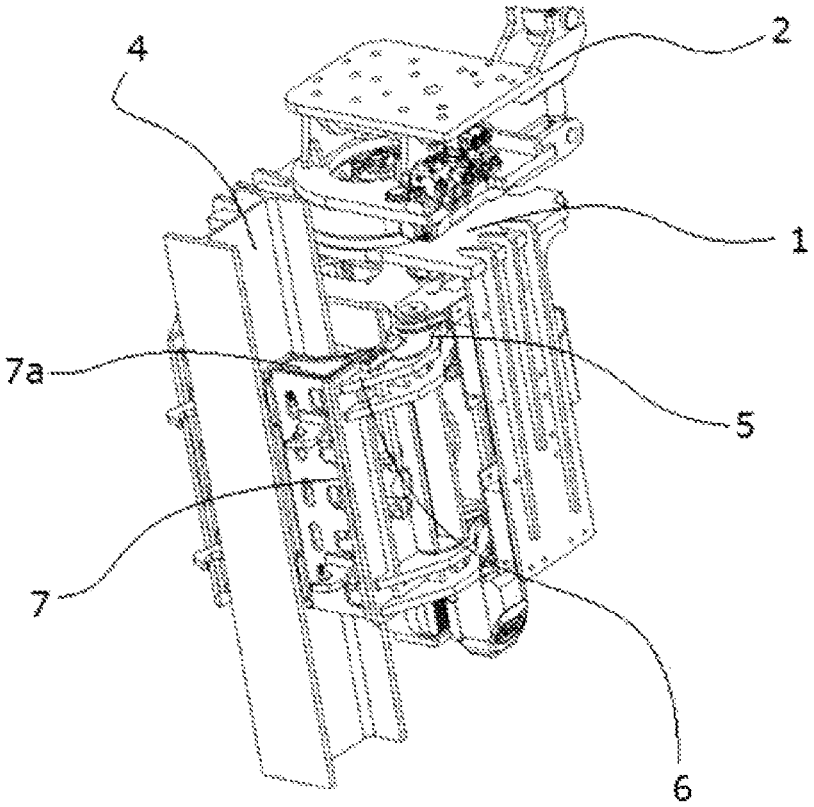
FIG. 1 is the perspective view of the pile driving system of the invention which is applied to an "H" shaped pile.
Figure 2:
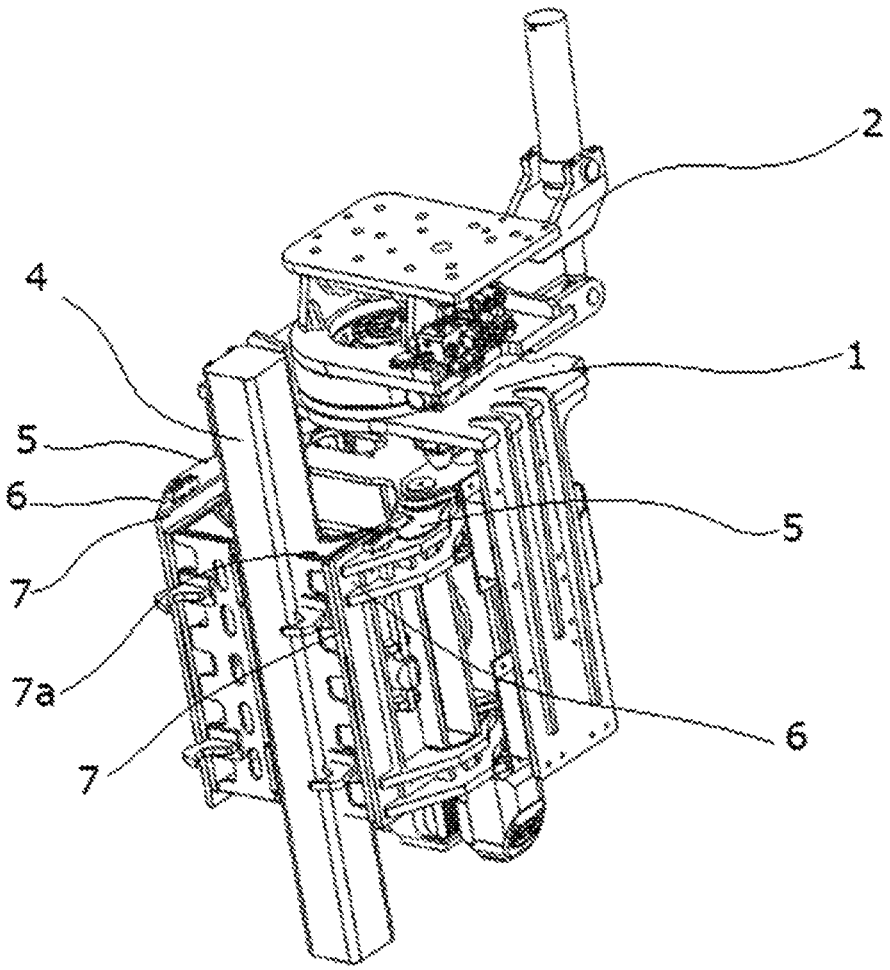
FIG. 2 is a perspective view of the pile driving system of the invention which is applied to a concrete pile.
Figure 3:
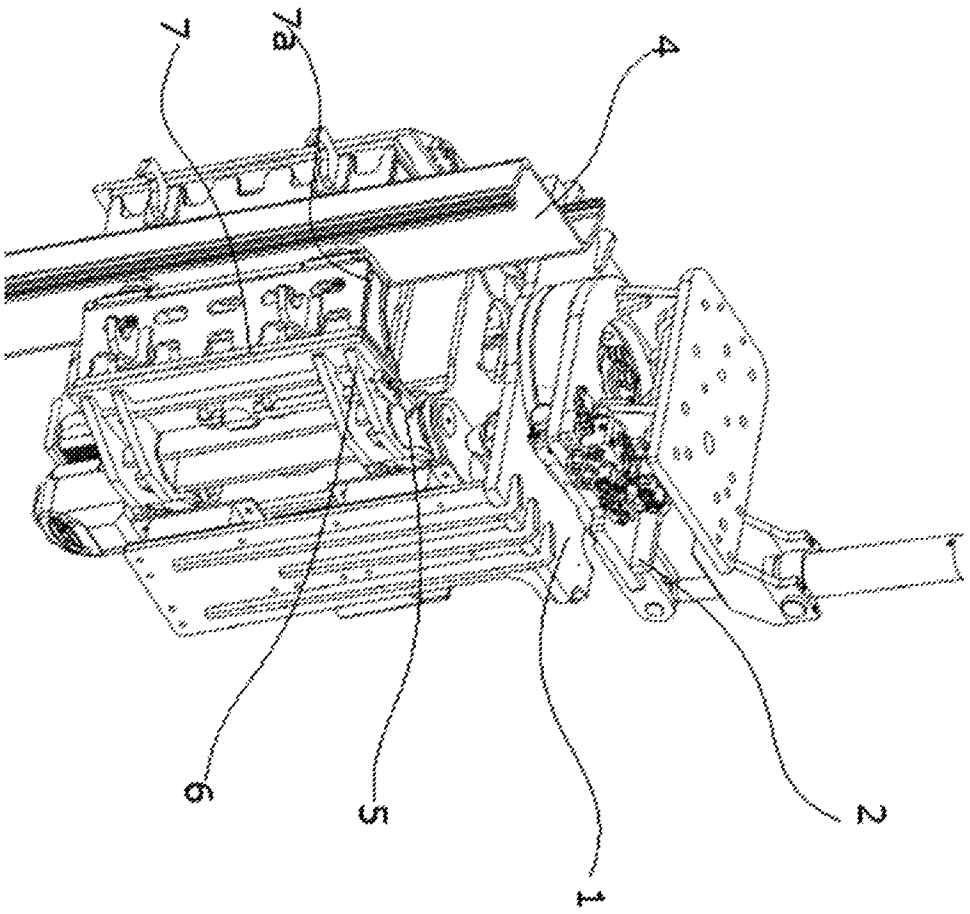
FIG. 3 is a perspective view of the pile driving view of the invention which is applied to a sheet pile.

REFERENCE NUMERALS OF THE SECTIONS AND PARTS TO SERVE FOR DESCRIBING THE INVENTION

1—Body
2—Body connection arrangement
3—Push piston
4—Pile
5—Arm
6—Jaw
6*a*—Wedge hole
6*b*—Wedge bearing
6*c*—Gap
6*d*—Mounting protrusion
7—Shoe
7*a*—Flat pressure shoe
7*b*—Inclined pressure shoe
7*c*—Mounting housing
7*d*—Pressure apparatus
8—Jaw recessed connection surface
8*a*—Jaw apex
8*b*—Jaw cavity
9—Shoe recessed connection surface
9*a*—Shoe apex
9*b*—Shoe cavity
10—Wedge stabilizing element
10*a*—wedge compression housing
10*b*—connection element
11—Securing wedge
F1—Pressure force
F2—Reaction force
F1'—Pressure force on the teeth
F2'—Reaction force on the teeth
F3—Combining force

DETAILED DESCRIPTION OF THE INVENTION

The pile driving system of the invention is mainly designed to be attached to the construction equipment for the piles to be driven into the ground. However, it is possible to be manufactured so as to be attached to the machines manufactured for pile driving only or any construction equipment, if preferred. It is obvious that the general view, the connection way and the sizes of the system may vary. However, the system of rigidly holding the pile as stated below comprises a development basically carried out. Therefore, while the power creating system in said system is preferably hydraulic, it may also comprise mechanic or hybrid systems. On the other hand, the general connection way, the control way, the sizes and the appearance may vary.

As can be seen in FIG. 1, FIG. 2, FIG. 3, FIG. 4 and FIG. 5, the pile driving system of the invention generally comprises a body (1), a body connection arrangement (2) connecting said body to the construction equipment, two arms (5) on said body (1) at least one of which is movable, and the jaw (6) at the end portion of said arms (5). These elements are the technical components of the system including the prior art. The opening-closing operation of said arms (5) is realized by the push piston (3) located at the rear portion of the body (1) or at the rear ends of the arms. The push piston (3) is hydraulic and it makes the front jaws (6) of the arms (5) closer, while being opened. In the contrary case, it moves them from each other, i.e. opens. The drive of the arms (5) herein is possible to be applied through different systems, while it is preferred to be provided by the hydraulic control by opening and closing them like pincers. For example it may be selected hydraulic, but the hinging may differ. Another construction may be hybrid systems being all mechanic or constituting the hydraulic and mechanic. Also, while at least one of the arms (5) is movable, both of them may optionally be movable. One of the arms (5) is selected as movable (it gets the movement from the push piston (3)) as in the figures given for only illustration.

Figure 4:
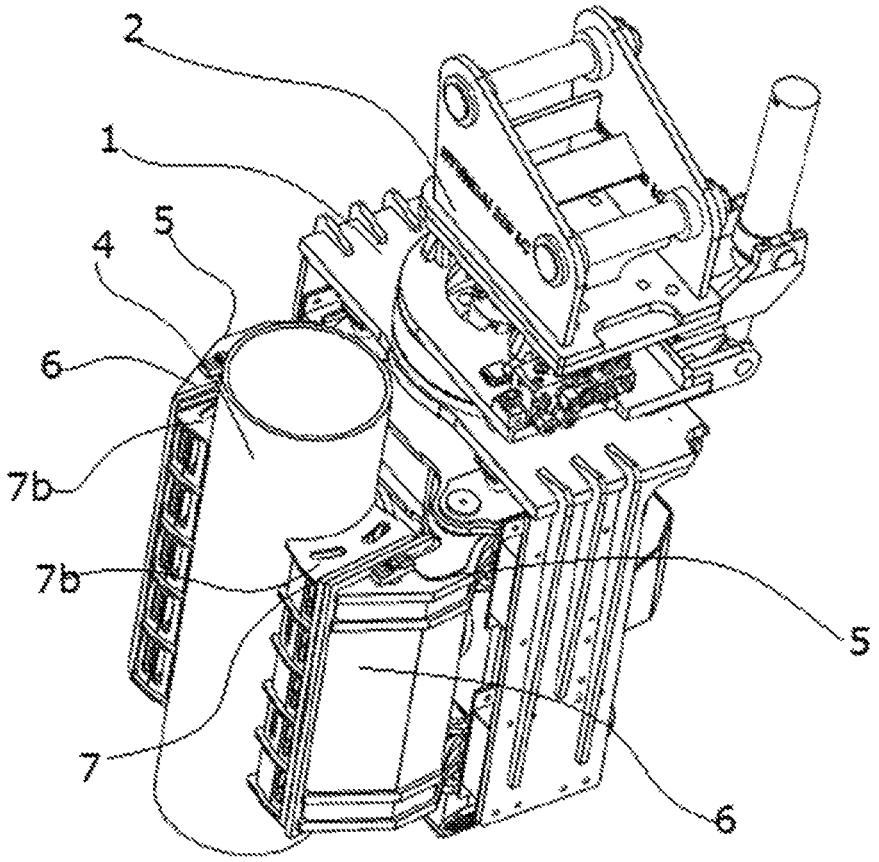
FIG. 4 is the perspective view of the pile driving system of the invention which is applied to a tubular pile.
Figure 5:
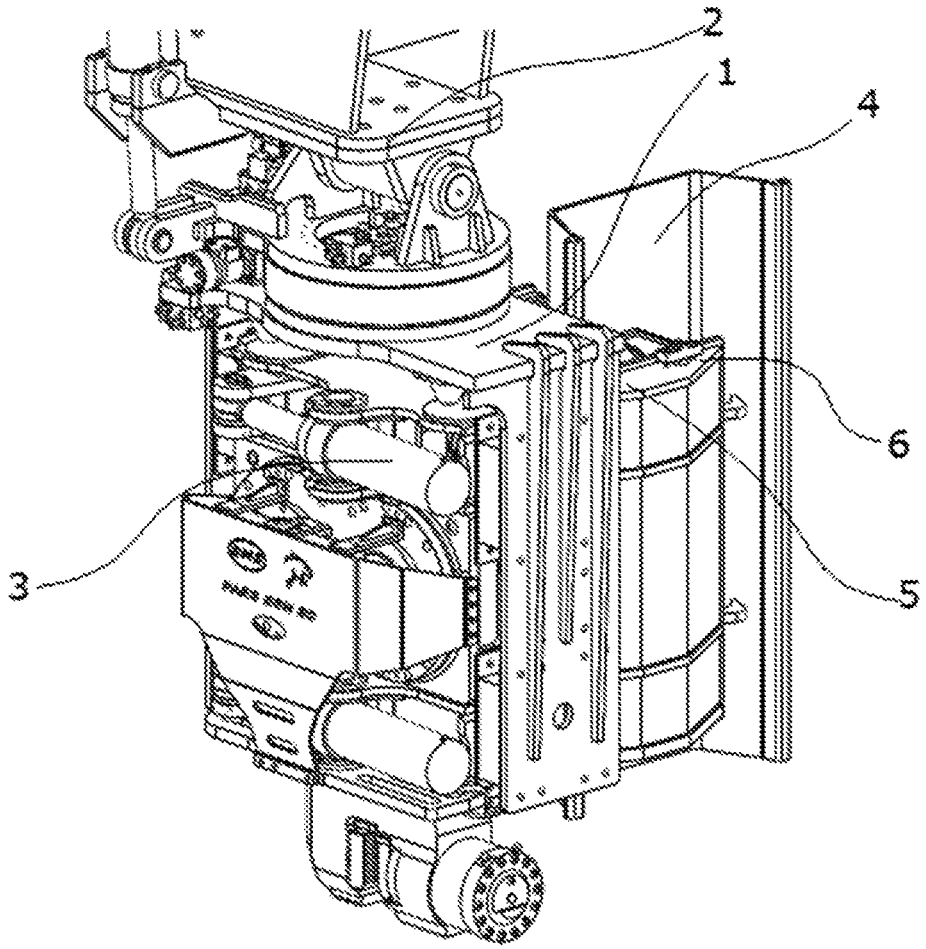
FIG. 5 is a perspective view from the rear of the pile driving system of the invention.
Figure 6:
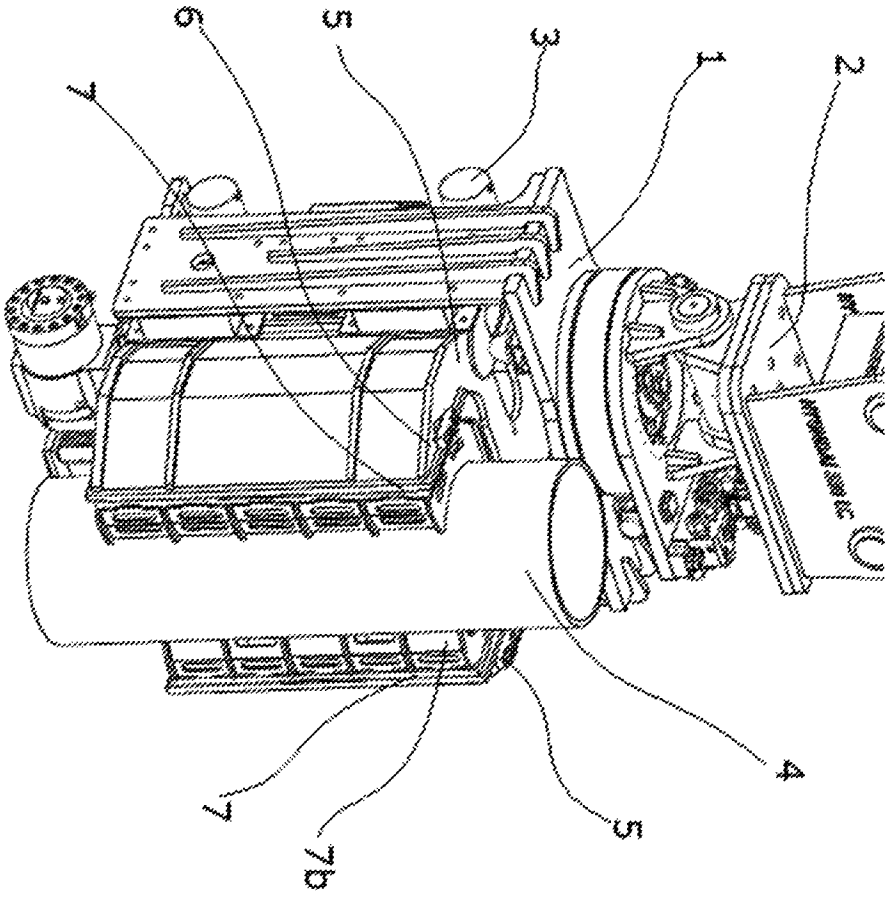
FIG. 6 is a perspective view of the pile driving system of the invention for a tubular pile from another angle.
Figure 7:
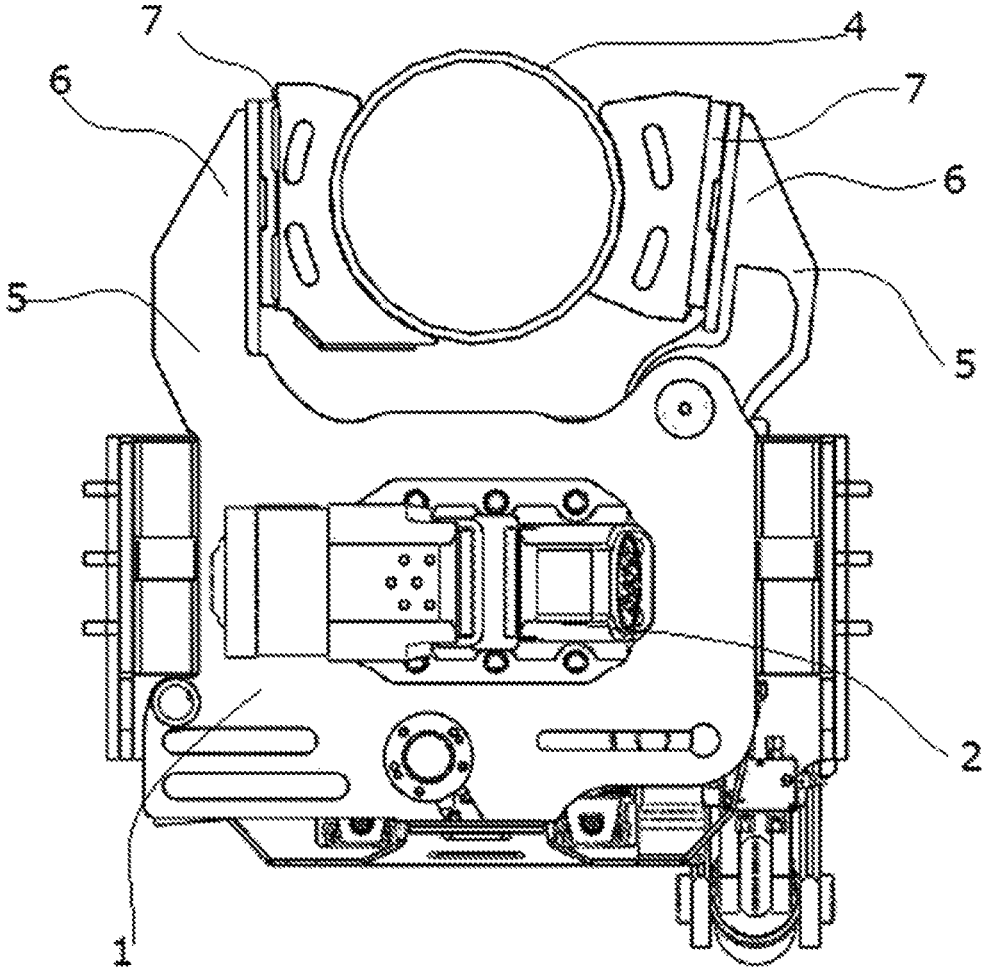
FIG. 7 is the perspective view from top of the pile driving system of the invention which is applied to a tubular pile.
Figure 8:
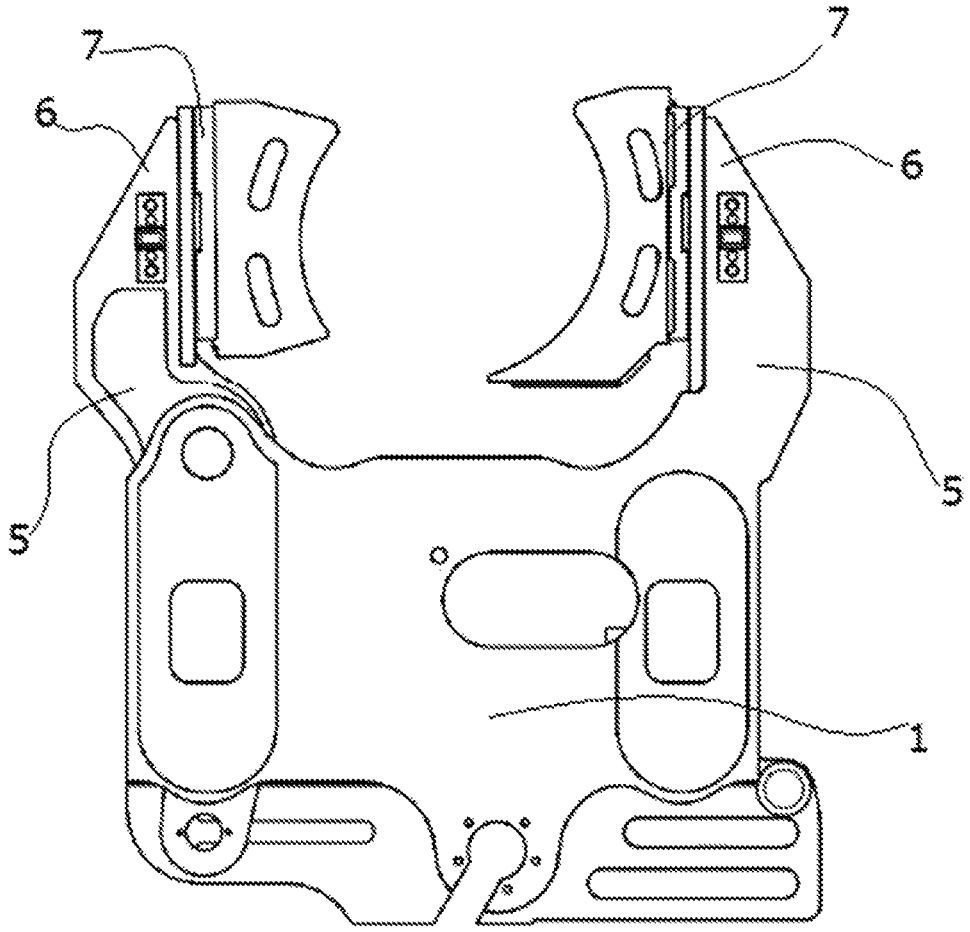
FIG. 8 is the top view of the shoe attached to the jaw in the pile driving system of the invention which is applied to a tubular pile with the shoes exposed.
Figure 9:
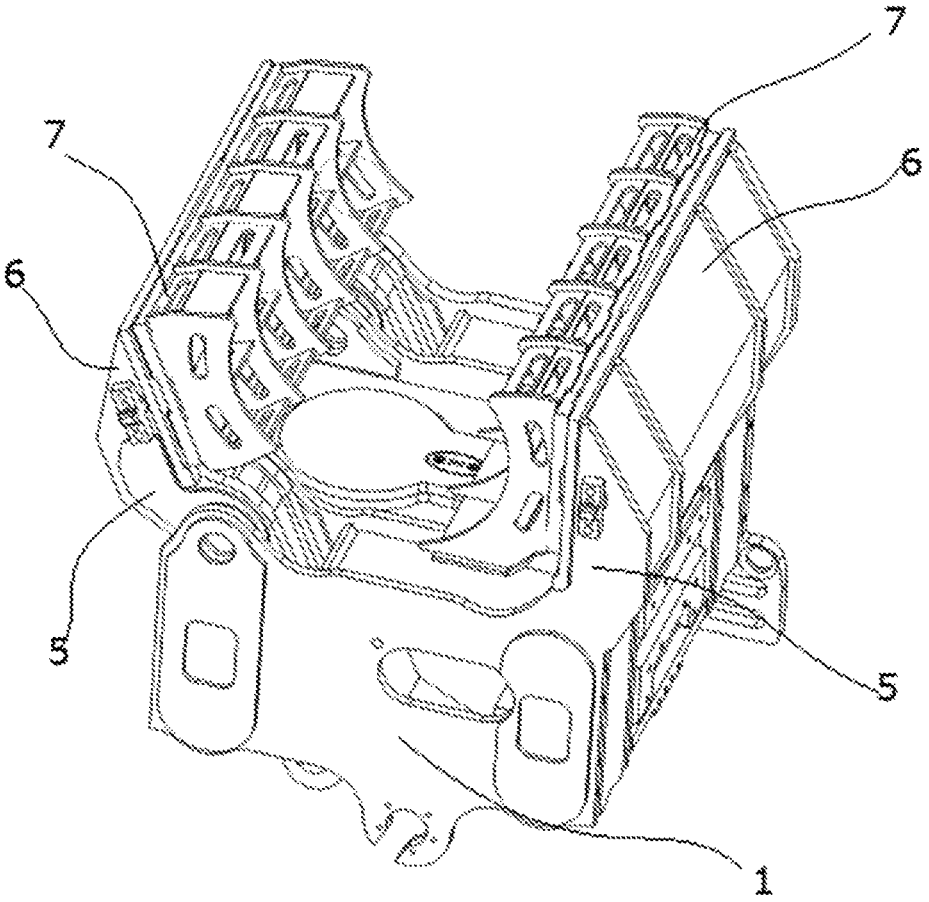
FIG. 9 is a perspective view of the shoe attached to the jaw in the pile driving system of the invention which is applied to a tubular pile with the shoes exposed.
Figure 10:
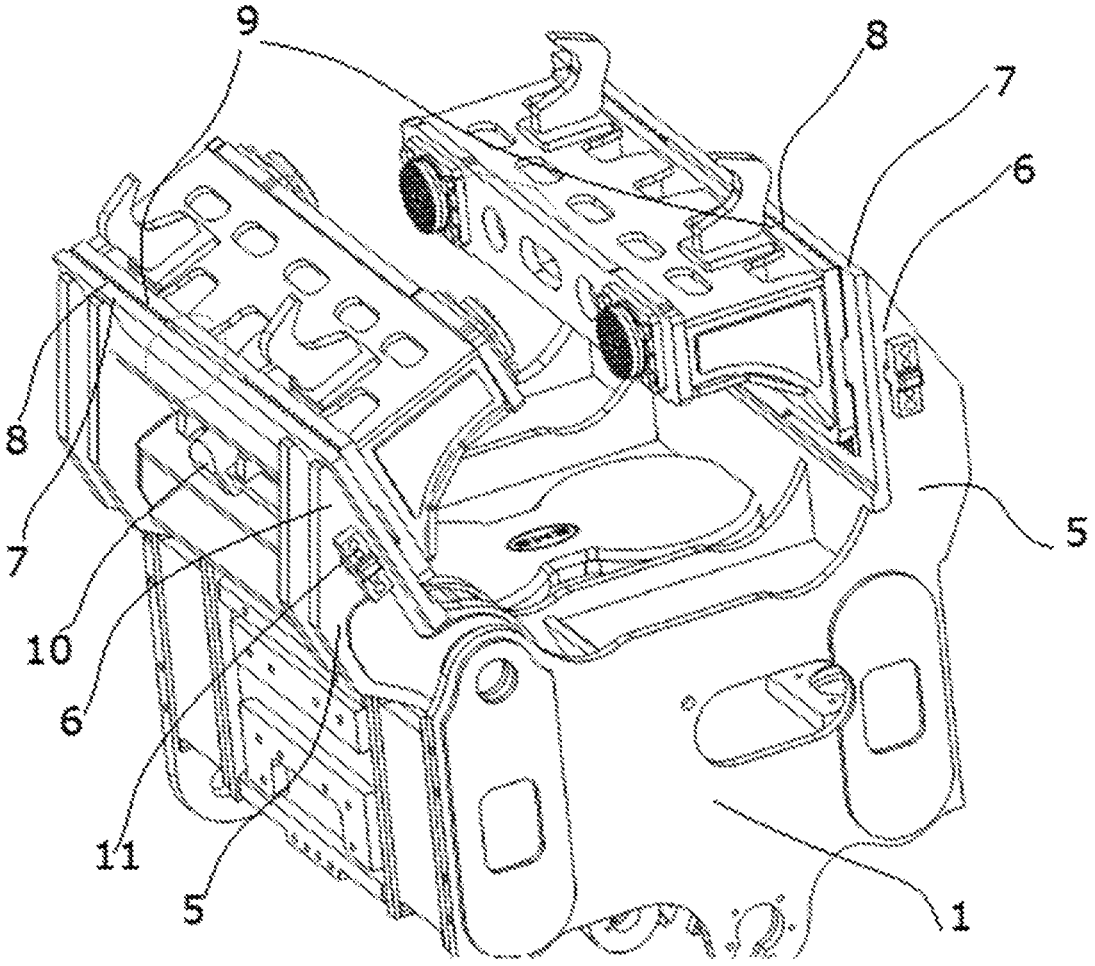
FIG. 10 is a perspective view of the shoe attached to the jaw in the pile driving system of the invention which is applied to a pile having a lamina or a flat surface with the shoes exposed.
Figure 11:
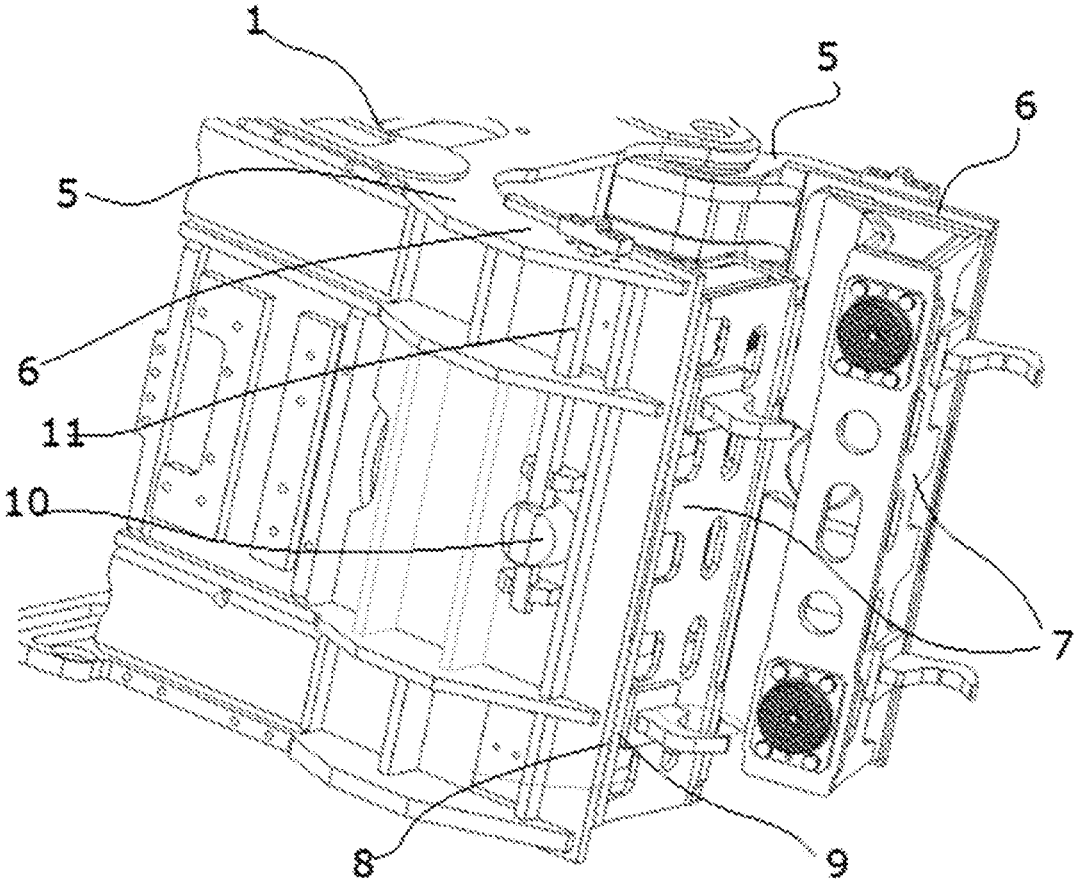
FIG. 11 is a perspective view from a different angle of the shoe attached to the jaw in the pile driving system of the invention which is applied to a pile having a lamina or a flat surface with the shoes exposed.
Figure 12:
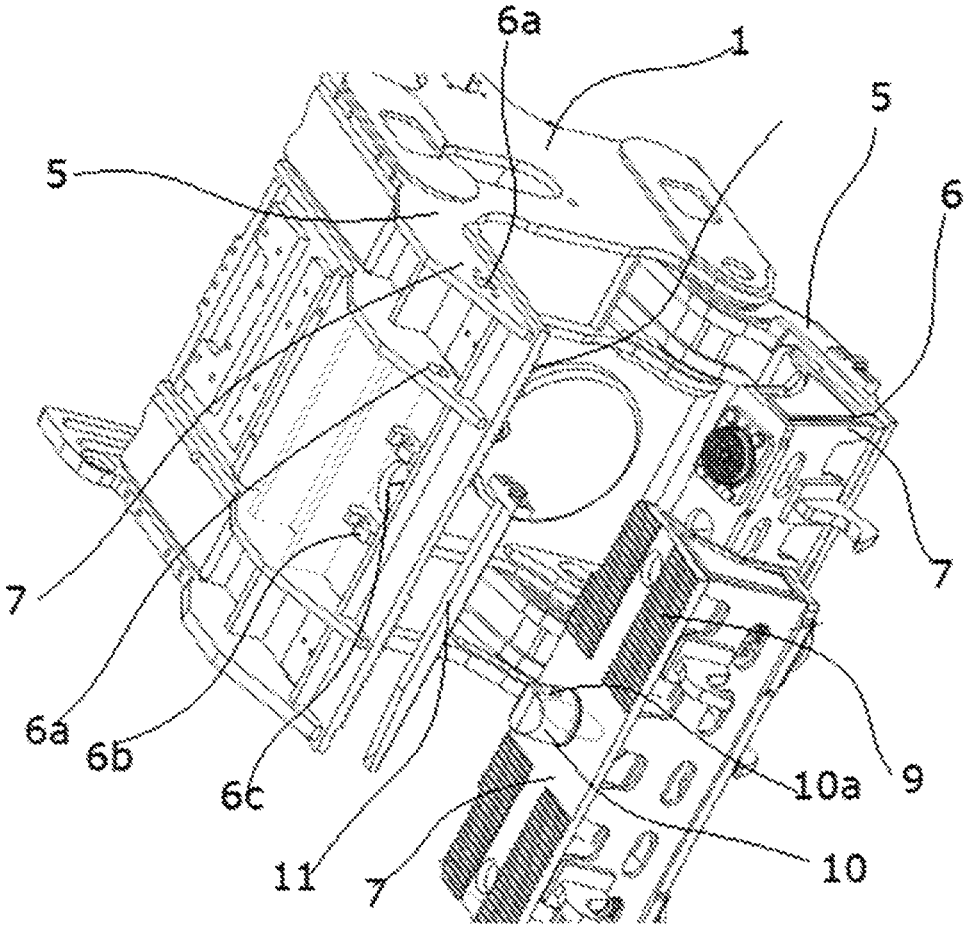
FIG. 12 is a perspective separate (exploded) view of the shoe attached to the jaw in the pile driving system of the invention.
Figure 13:
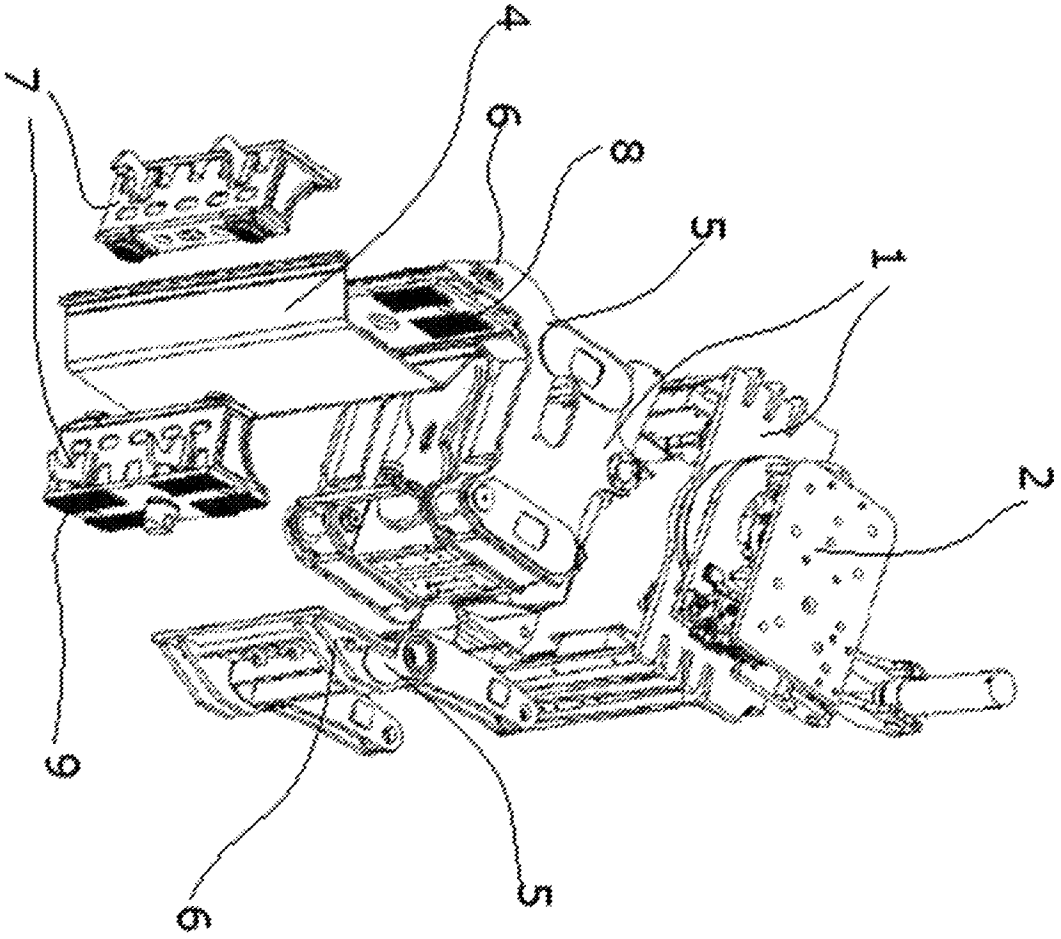
FIG. 13 is a perspective view of the shoe attached to the jaw and the shoe separately (exploded) in the pile driving system of the invention.
Figure 14:
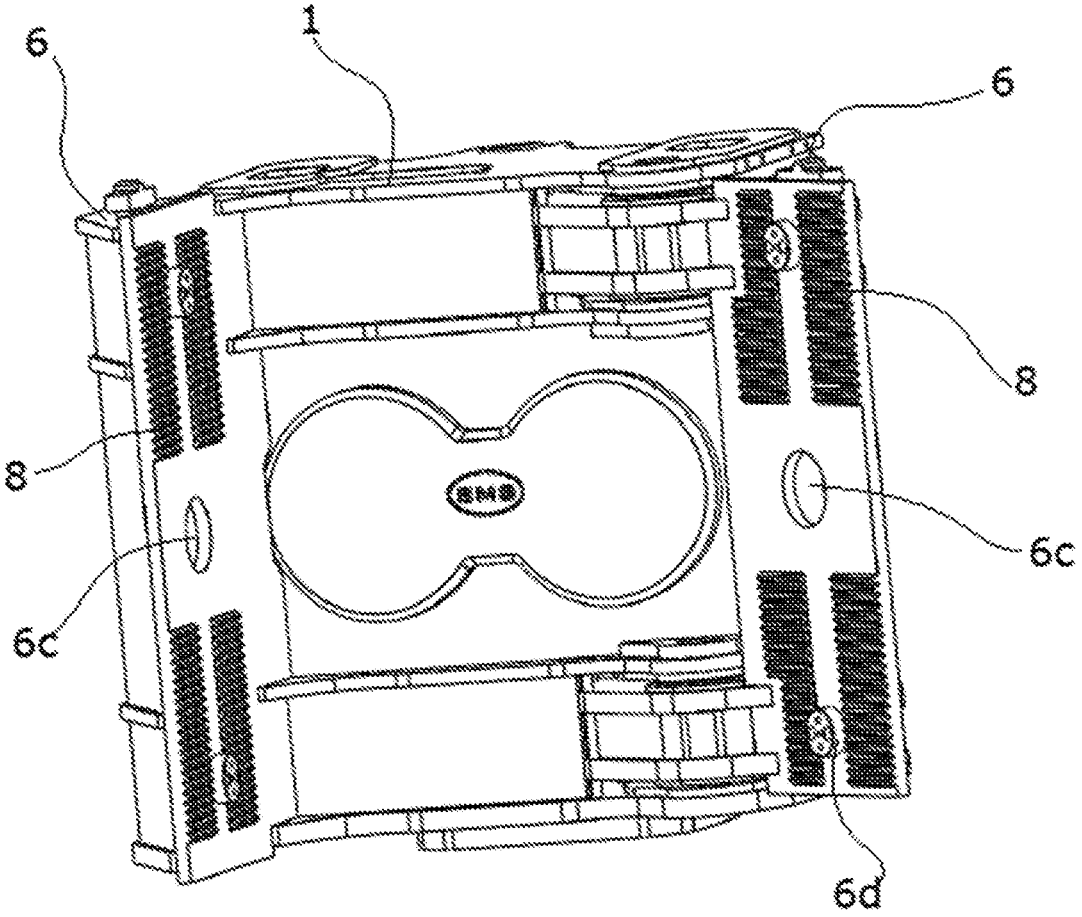
FIG. 14 is the perspective view of the pile driving system of the invention without the shoes attached to the jaws.
Figure 15:
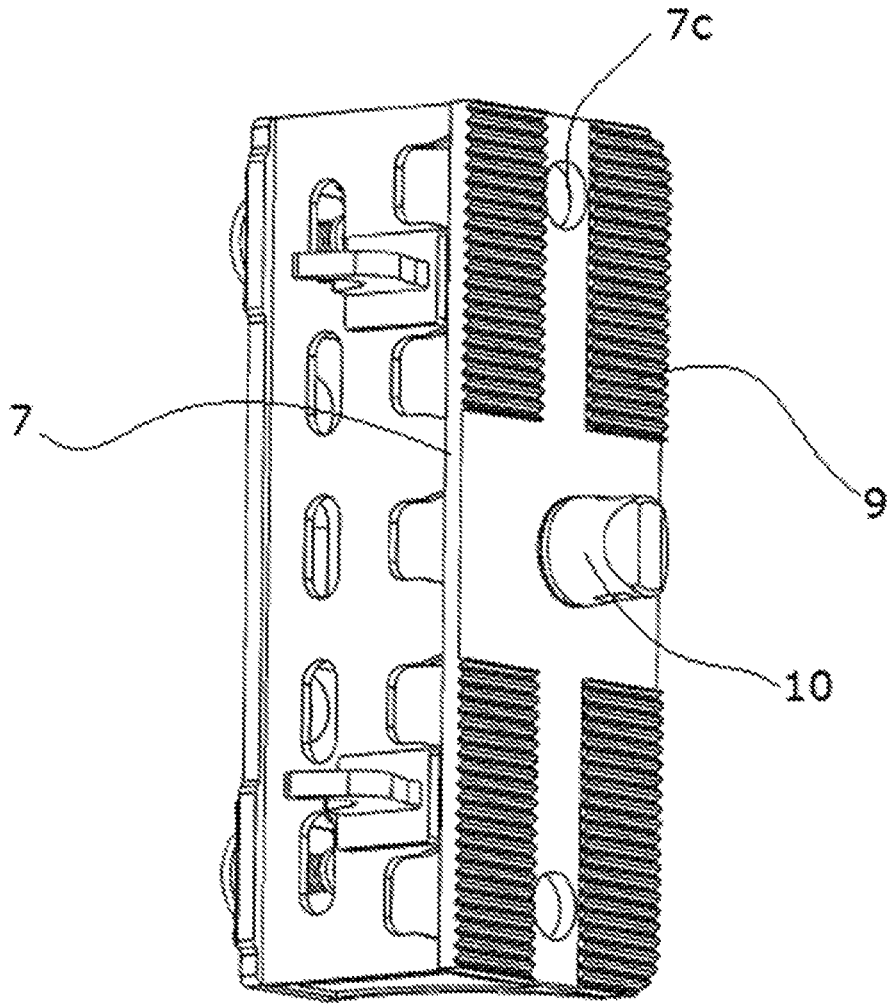
FIG. 15 is a perspective view of the shoe used in the pile driving system of the invention.
Figure 16:
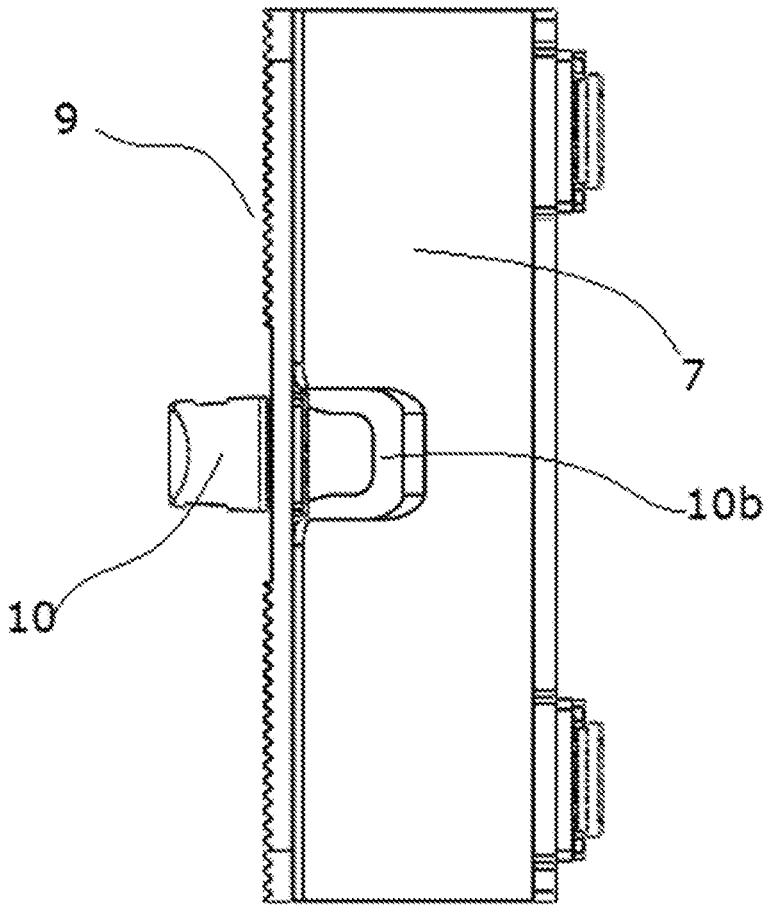
FIG. 16 is a projection view from the front of a shoe used in the pile driving system of the invention.
Figure 17:
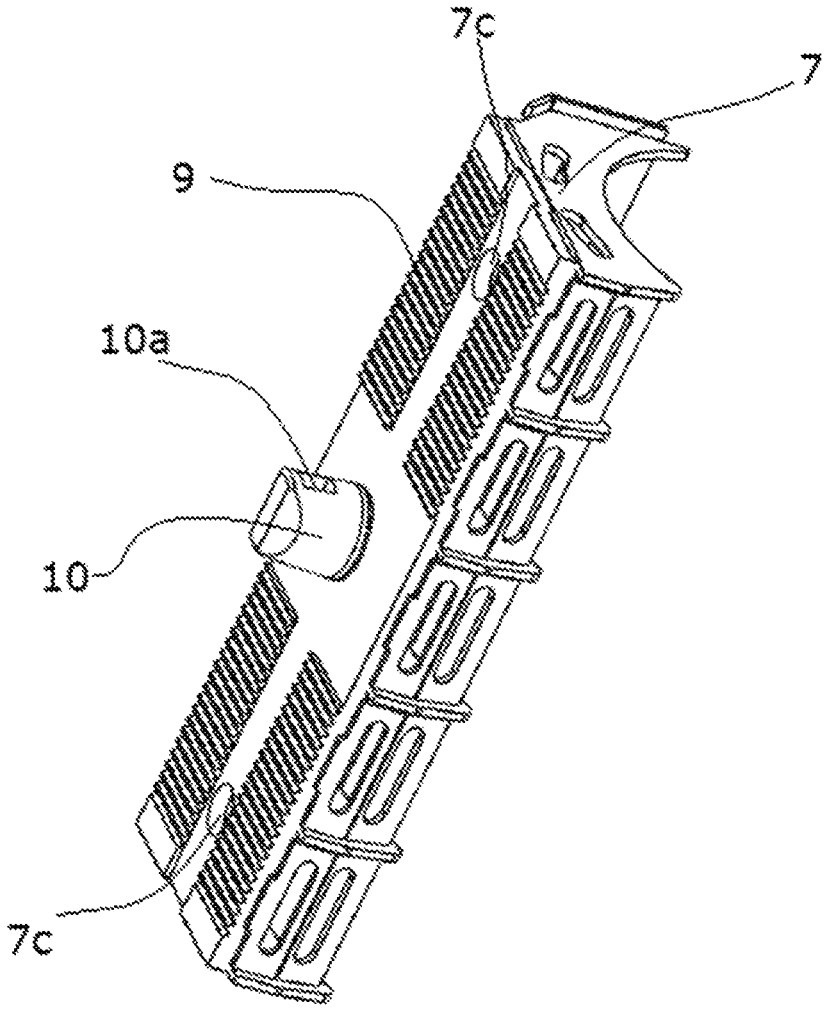
FIG. 17 is a perspective view of a different type of shoe used in the pile driving system of the invention.
Figure 18:
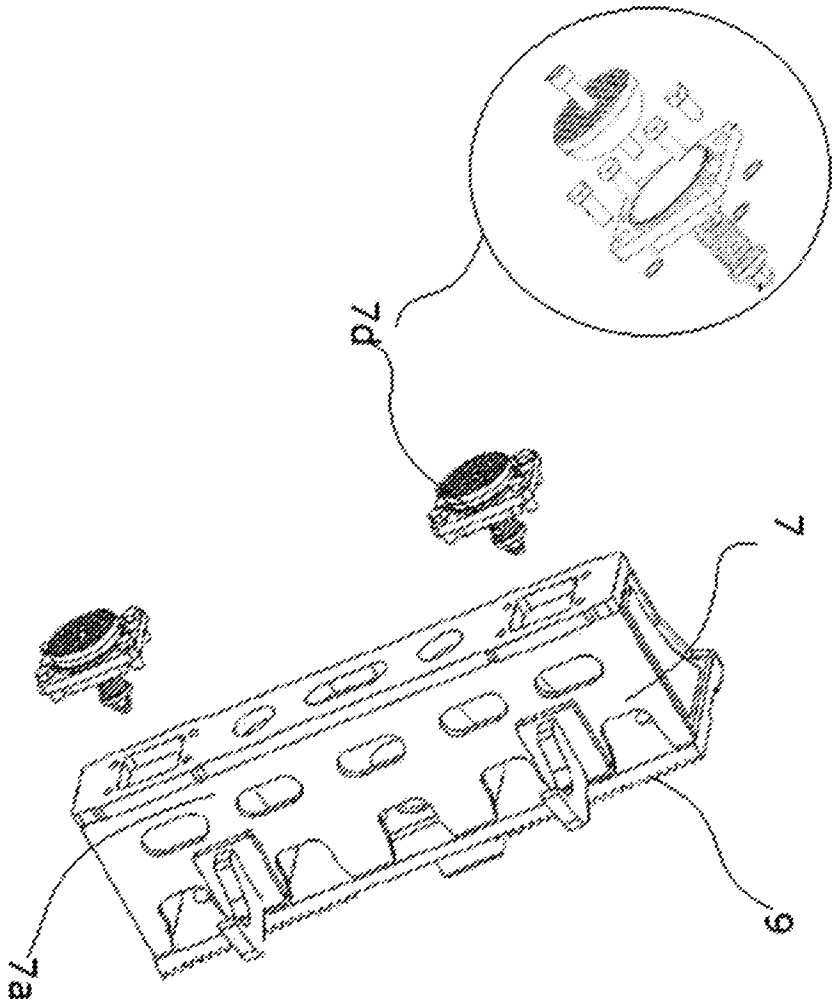
FIG. 18 is a partial perspective view of the shoe used in the pile driving system of the invention.
Figure 19:
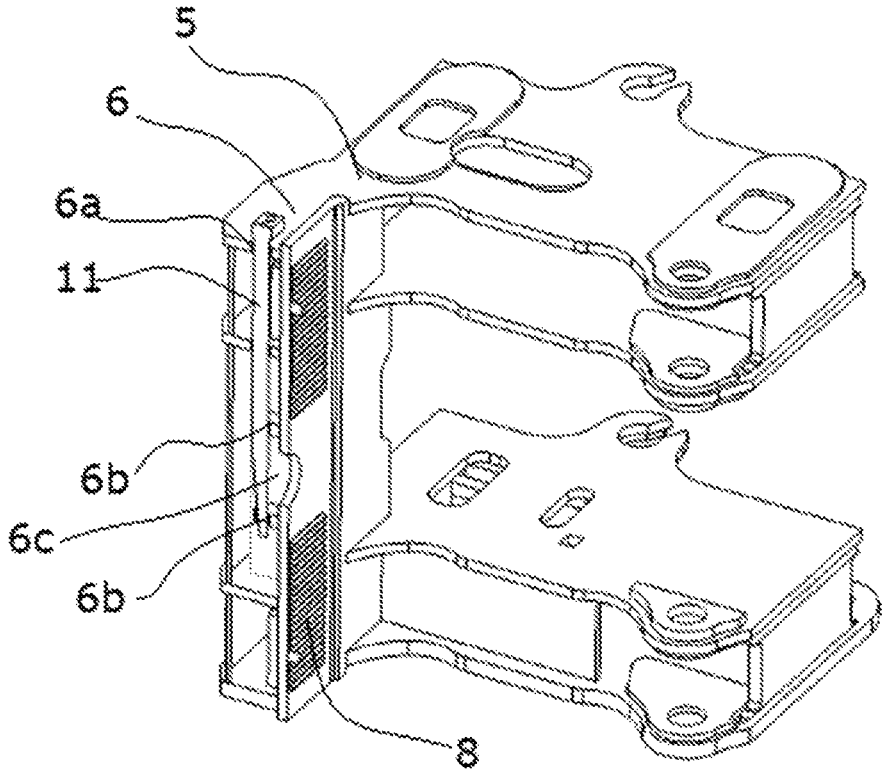
FIG. 19 is a perspective view of the jaw used in the pile driving system of the invention cross-sectional from the end portion (mounting portion) thereof.

In the pile driving system of the invention, as it can be seen from the images given for illustrative purposes in FIG. 5 and FIG. 6, at the ends of the arms (5) located are the jaws (6) and the shoes (7) being easily assembled and disassembled on said jaw (6). The subject matter of the invention is to develop a technique comprising the connection way of the shoes (7) to the jaws (6). While the attachment constructions of the shoes (7) to the jaw are the same, the front portions of the shoes may differ according to the profile of the pile (4). For example, a flat pressure shoe (7*a*) is used having a flat surface formed according to the "H" shaped pile (4) in FIG. 1. Similarly, a flat pressure shoe (7*a*) is used in FIG. 2, being convenient to a concrete pile (4). For a further similar profile given in FIG. 3, a flat pressure shoe (7*a*) is used according to a pile (4) in the form of a sheet pile having a flat surface. In FIG. 4, the pile (4) has a different shaped, tubular profile wherein inclined pressure shoe (7*b*) is used with suitable pressure areas of the shoe (7) according to the circular profile. In FIG. 6, FIG. 7, FIG. 8, and FIG. 9, inclined pressure shoe (7*b*) is used. However, it should be noted that the place where the shoe (7) is in connection with the jaw (6) is important rather than the place where the shoe (7) grasps the profile. Thus, "shoe (7)" term will be used herein for any shoes without considering the profile of the shoe, i.e. for all shoes with all profiles. Similarly, "pile (4)" term will be used for all piles such as a pile with a flat surface, a pile with an inclined surface, a tubular pile, etc. while the pile (4) profiles may be different. In FIG. 6, FIG. 7, FIG. 8, and FIG. 9, a tubular pile (4) and a shoe (7) having pressure profiles according to it (i.e. inclined pressure shoe (7*b*)). In FIG. 10 and FIG. 11, a shoe (7) is used having a profile with a flat surface (flat pressure shoe (7*a*)).

As it can be seen from the representative images in FIG. 10, FIG. 11, FIG. 12, and FIG. 13, the invention mainly comprises a body (1), a body connection arrangement (2) connecting said body to the construction equipment, two arms (5) on said body (1) at least one of which is movable, a jaw recessed connection surface (8) comprising the jaw (6) at the ends of said arms (5) and formed at the inner portion of said jaw (6), and at least one shoe (7) having the shoe recessed connection surface (9) creating a symmetric profile so as to overlap said jaw recessed connection surface (8) and corresponding to it when attached.

The pile driving system of the invention comprises wedge stabilizing element (10) located on the shoe (7) allowing the jaw (6) including the jaw recessed connection surface (8) and the shoe (7) including the shoe recessed connection surface (9) to be rigidly connected to each other, at least one gap (6*c*) created on the jaw (6) into which said wedge stabilizing element (10) enters, and the securing wedge (11) providing the rigidity during the connection of said wedge stabilizing element (10). A structure is formed which comprises a wedge hole (6*a*) and a wedge bearing (6*b*) such that the securing wedge (11) is easily assembled to the jaw (6) and disassembled from the jaw (6) and bears it. The construction herein should be as follows: The connection between the shoe (7) and the jaw (6) should be as a connection of two recessed surfaces rather than a connection of two flat surfaces. The recessed surfaces will face the vertical forces. In other words, the sliding of the shoe (7) on the jaw (6) will be prevented considerably. This is because the machine component which was named as a kind of shoe, but functioning as a pressure plate used to be directly connected to the jaw via the attachment elements such as screw or pins in the prior art, which leads to huge burdens on the attachment elements. In the system of the invention, the jaw (6) and the shoe (7) connection surfaces carry the burden (the pressure force) as described below. The jaw recessed connection surface (8) on the jaw (6) and the shoe recessed connection surface (9) on the shoe (7) are the main components of the invention and they will be described below in detail. In order to tightly connect the shoe (7) to the jaw (6) and to connect the recessed surfaces to each other in an exact overlapping manner, at least one wedge stabilizing element (10) is located on the shoe, preferably in the middle portions (7). A hole (6*c*) is created on the jaw (6) into which the wedge stabilizing element (10) enters. There is at least one wedge stabilizing element (10) and it is preferably located at the middle portion of the shoe (7). However, the number thereof may be increased. There is preferably one hole (6*c*) and it is on the hole area into which the wedge stabilizing element (10) may enter. During the connection, the wedge stabilizing element (10) enters into the hole (6*c*). A wedge compression housing (10*a*) is formed on the wedge stabilizing element (10) in order to prevent the wedge stabilizing element (10) to be detached by itself. The securing wedge (11) is inserted thereto and the rigidity is enabled. The rigidity here means that they fully grasp each other, there is no vibration or gap, and however they may be easily disassembled and assembled back if desired. In order to easily handle the securing wedge (11) and to increase the rigidity, the wedge hole (6*a*) into which the securing wedge (11) enters in the jaw (6) and the wedge bearing (6*b*) on which the securing wedge (11) will be supported (or located) are formed.

FIG. 14, FIG. 15, FIG. 16, FIG. 17, FIG. 18, and FIG. 19, the recessed surfaces created on the jaw (6) and shoes (7) and the connection of these two components are seen in detail. The jaw (6) comprises at least one jaw recessed connection surface (8) at the side corresponding to the connection surface with the shoe (7) such that it will be at the inner side. The shoe (7) to be mounted on this jaw (6) comprises at least one shoe recessed connection surface (9) at the side to be mounted on the jaw (6). The jaw recessed connection surface (8) and the shoe recessed connection surface (9) have profiles corresponding to each other and constituting symmetry. In other words, the surfaces should overlap each other almost completely when two surfaces correspond to each other. The term recessed may refer to the triangular recesses and protrusions such as the profiles given in FIG. 25*a* and FIG. 25*b*, it may also refer to the inclined, shaped like saw tooth, or even rectangular teeth. The aim of this is to bear the burden of the pressure force applied on the pile (4) which is rigidly clamped between the jaws (6) upon the overlapping of the surfaces. In other words, the surfaces are also the machine components bearing the burden (facing the forces and providing the adequate strength against the forces). This used to cause a need for a plurality of strong attachment elements such as pins or screws in order to connect the jaw and the shoes, as is known from the prior art. These two recessed connection surfaces are combined with the jaw (6) and the shoe (7). The mounting protrusion (6*d*) is located at the jaw (6) and the mounting housing (7*c*) is located at the shoe (7). These structures are for ease of mounting. The protrusion or the cavity functions as a technical component and the housing receiving said component which are intended to be interlocked. Thus, these structures may be the structures such as welded connections or pins, while they may be projections connected through screws. This mounting protrusion (6*d*) enters into the mounting housing (7*c*) created on the shoe (7). The opposite of that may also occur. In other words, the mounting protrusion may be provided on the shoe, and the mounting housing on the jaw. The important point is that this mounting projection (6*d*) enters into the mounting housing (7*c*) and it facilitates the mounting. Thus, a worker easily advances the shoe (7) towards the jaw (6) and combines the jaw (6) and the shoe (7) by an operation (move). There is at least one wedge stabilizing element (10) located at the shoe (7). However, there may be more of it. Because there is no much force laterally coming to the system, it is designed to prevent the detachment of the jaw (6) and the shoe (7). The wedge stabilizing element (10) is a protrusion located together with the connection element (10*b*) at the inner side on the shoe (7) and having a wedge compression housing (10*a*) which is a gap into which the securing wedge (11) enters at the end portion, and it enters into the gap (6*c*) at the jaw (6) during the assembly. While assembling, the wedge stabilizing element (10) enters into the gap (6*c*), the securing wedge (11) is inserted into the wedge compression housing (10*a*) through the wedge hole (6*a*) created on the jaw (6). The securing wedge (11) stays at the wedge bearing (6*b*) here. Surely, the wedge bearing (6*b*) and the wedge hole (6*a*) may optionally be eliminated. The important point is that the securing wedge (11) enters into the wedge compression housing (10*a*) in the wedge stabilizing element (10) and prevents the shoe (7) to move away from the jaw (6) by itself or by a force. In other words, the securing wedge (11) maintains the rigidity of the system. Moreover, the securing wedge (11) preferably has a slight cone shape.

In the pile driving system of the invention, the recessed connection surfaces on the shoe (7) and the jaw (6) are combined as stated above. During this combination, the rigidity is provided by the wedge stabilizing element (10) on the shoe (7) entering the gap (6*c*) and the securing wedge (11) being inserted into the wedge compression housing (10*a*). However, the opposite case may optionally occur. In other words, the wedge stabilizing element (10) is formed on the jaw (6) and the wedge bearing (6*b*) on the shoe, and by a similar arrangement, i.e. by the securing wedge (11), the compression is enabled. It is a significant functional novelty that the jaw recessed connection surface (8) located at the jaw (6) and the shoe recessed connection surface (9) located at the shoe (7) come together by an overlapping manner. It is a characteristic feature that such a rigid connection is provided and said rigid connection may easily attached and detached optionally. Thus, the rigidity may be provided for the shoe (7) and the jaw (6) through a sliding connection and a pin passing therebetween to prevent these slides to move back.

Figure 20:
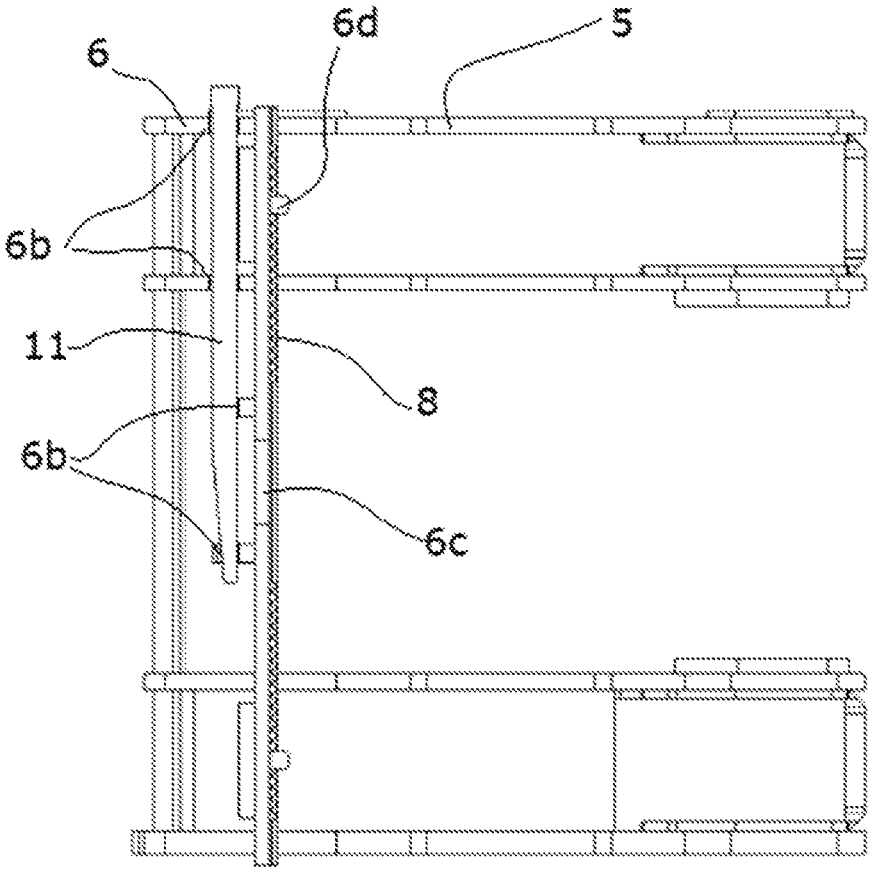
FIG. 20 is a projection view of the jaw used in the pile driving system of the invention cross-sectional from the end portion (mounting portion) thereof.
Figure 21:
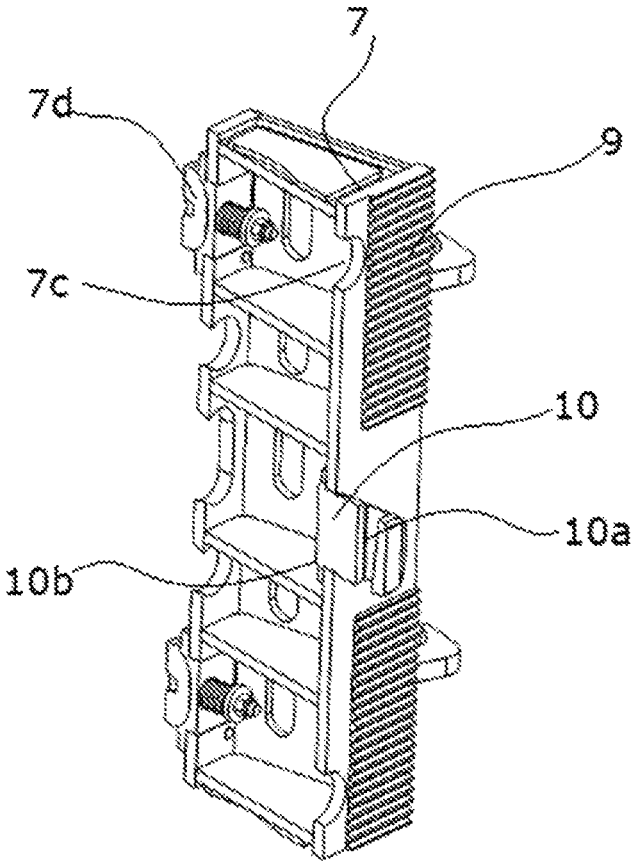
FIG. 21 is a perspective view of the shoe used in the pile driving system of the invention cross-sectional from the mounting location thereof.

FIG. 20 shows the cross sectional projection view of the jaw (6). It comprises the jaw recessed connection surface (8) located at the jaw (6) and realizing the connection with the shoe (7), the mounting projection (6*d*) at one side of the same surface, the gap (6*c*) into which the wedge stabilizing element (10) enters, the wedge hole (6*a*) into which the securing wedge (11) enters and located, and the wedge bearing (6*b*). Similarly, it obviously comprises the shoe recessed connection surface (9) on which the connection of the shoe (7) with the jaw (6) occurs, the wedge stabilizing element (10) providing the rigidity by the help of the securing wedge (11) and by passing through the gap (6*c*) on the jaw (6), the connection element (10*b*) enabling said wedge stabilizing element (10) on the shoe (7), and the mounting housing (7*c*) which is the gap into which the mounting protrusion (6*d*) on the jaw (6) enters. It is obvious that the pile (4) comprises pressure apparatuses (7*d*) according to the profile thereof for only certain pile types.

Figure 22:
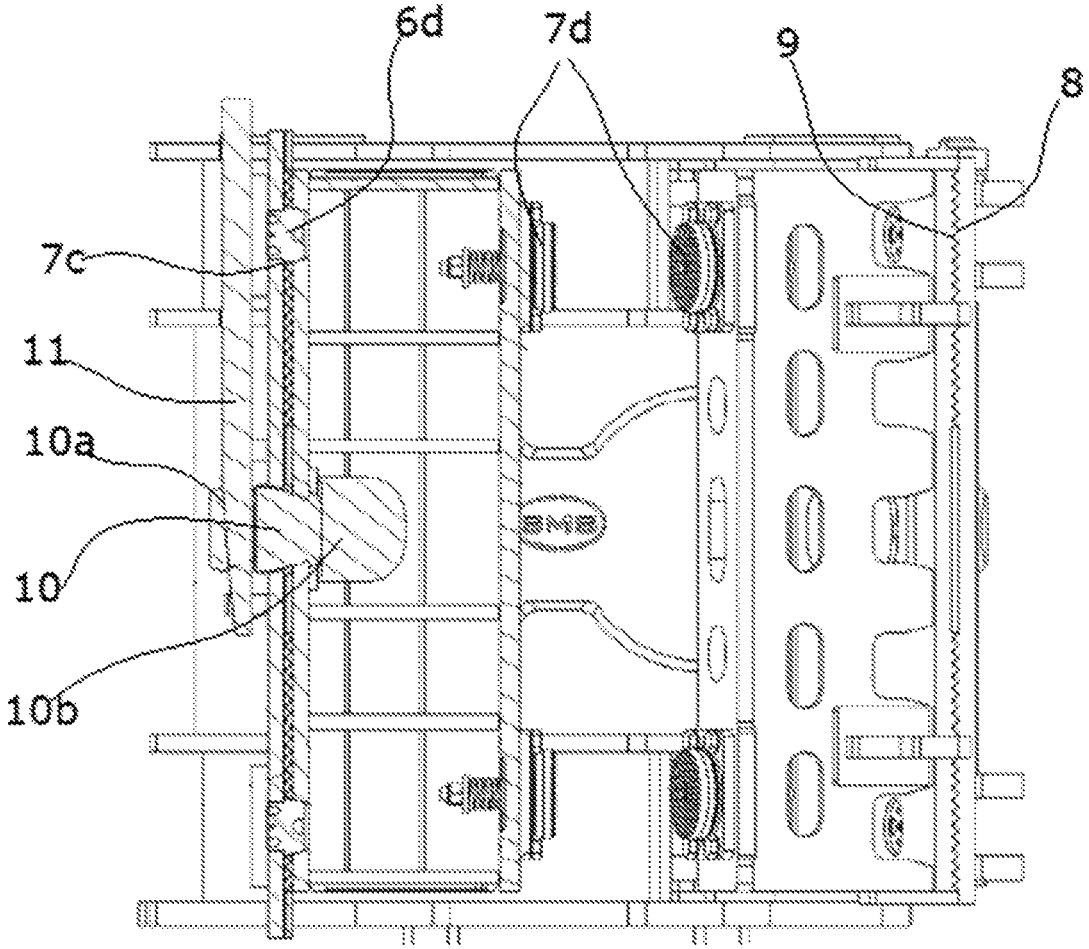
FIG. 22 is a cross-sectional projection view from the front of a shoe and jaw used in the pile driving system of the invention.
Figure 23:
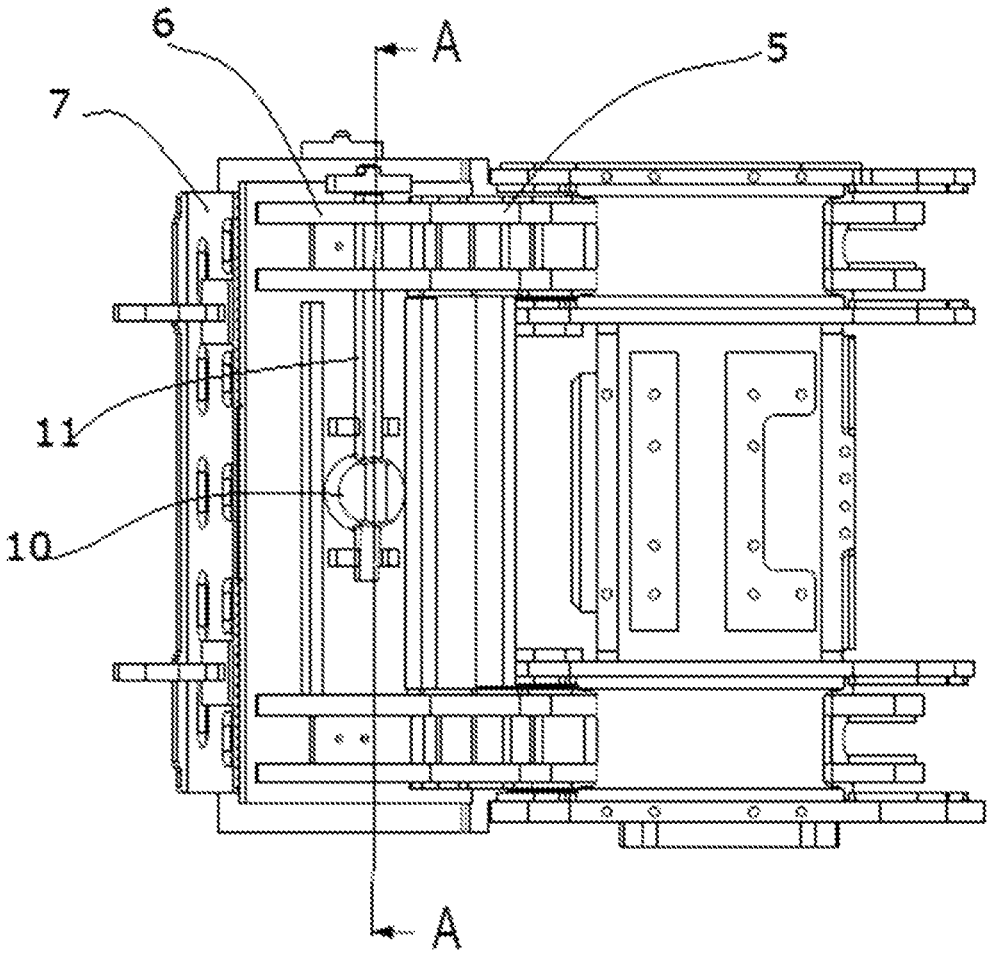
FIG. 23 is a profile projection view of a shoe and jaw used in the pile driving system of the invention.
Figure 24:
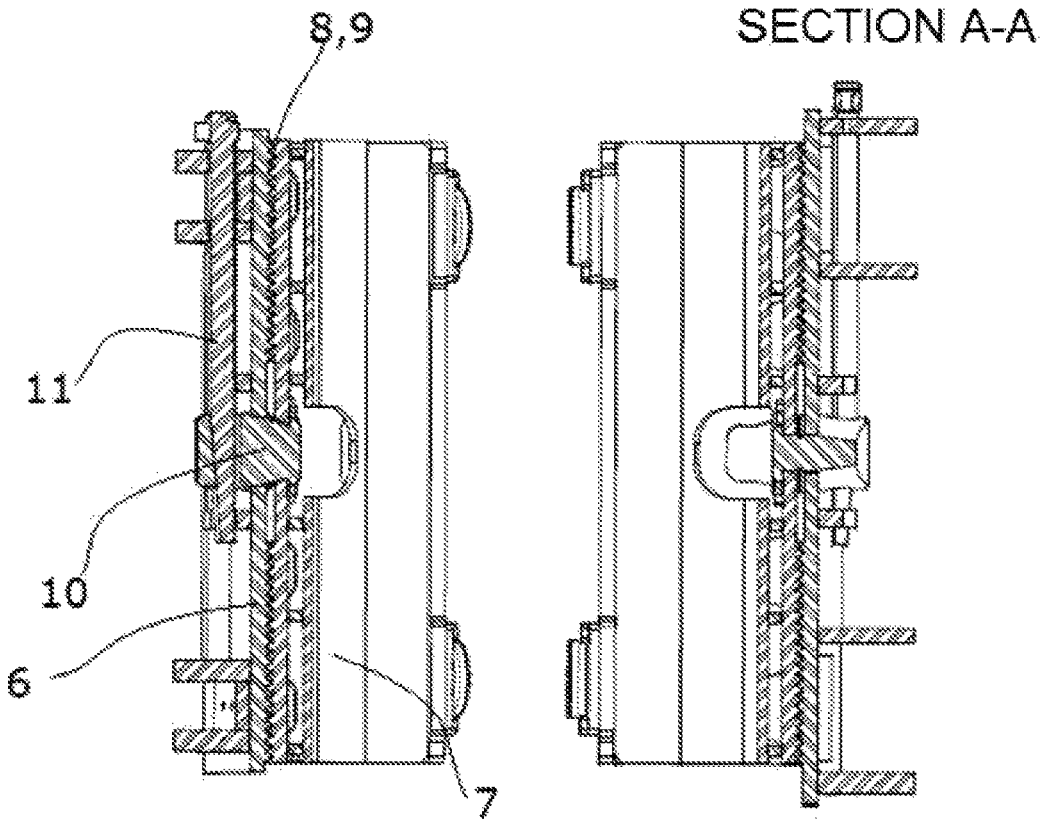
FIG. 24 is a front sectional projection view of the pile driving system of the invention given in FIG. 23.

In FIG. 22 shows a cross sectional image of a part of the jaw (6) and the shoe (7) that are assembled, FIG. 23 shows the side view of the jaw and the shoe (7), and FIG. 24 shows the whole cross sectional image in a certain orientation with the angle of FIG. 23.

Figure 25A:
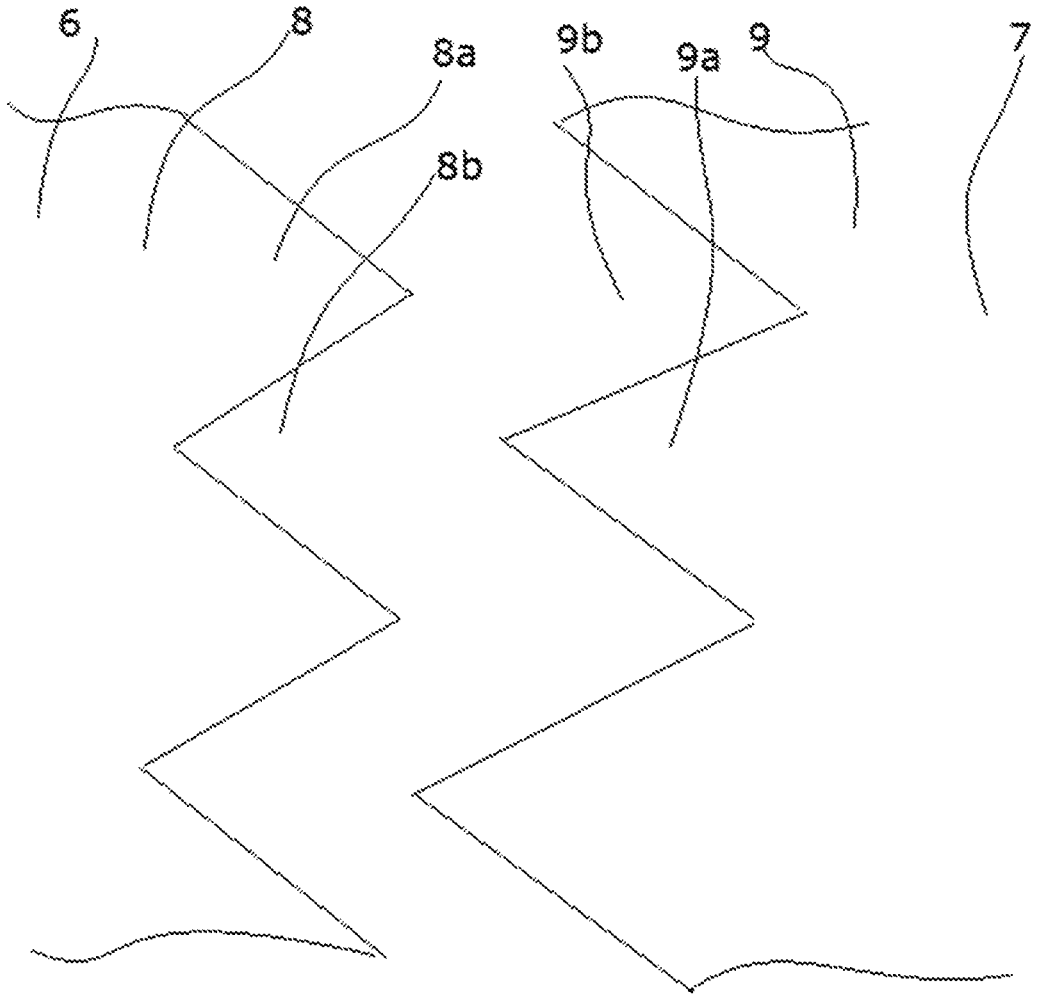
FIGS. 25*a* and 25*b* illustrates the representative view of the surface between the jaw and the shoe used in the pile driving system of the invention.
Figure 25B:
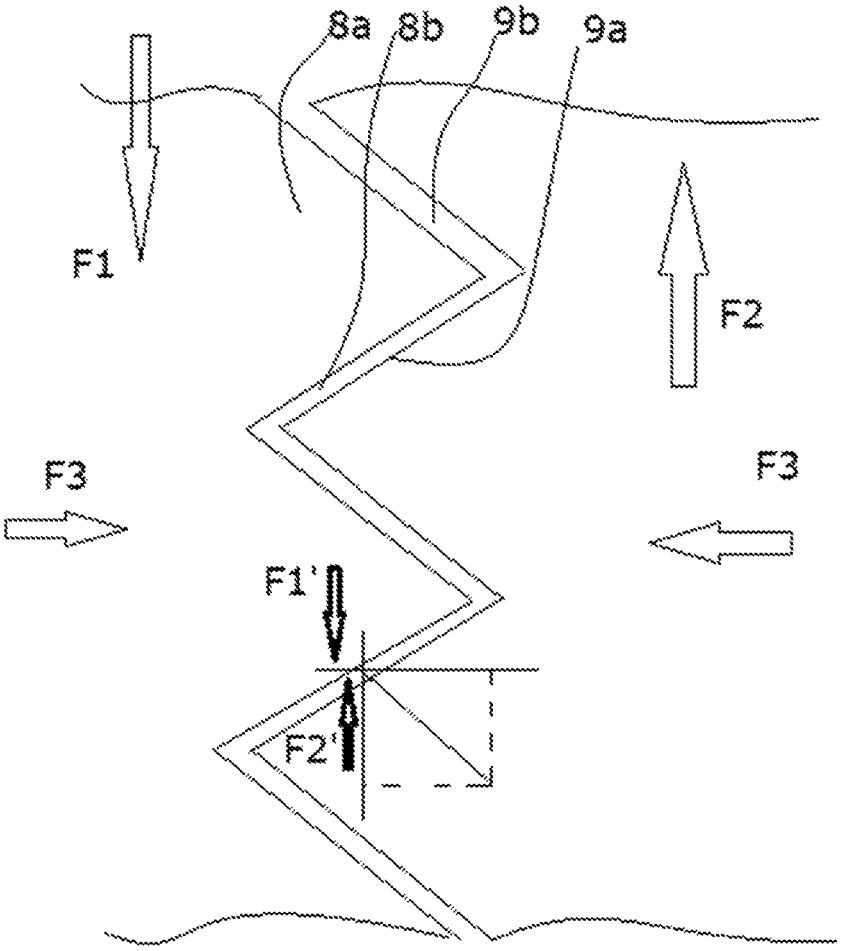

FIG. 25*a* and FIG. 25*b* shows the representative image of the jaw recessed connection surface (8) on the jaw (6) and the shoe recessed connection surface (9) on the shoe (7) which are the important constituents of the pile driving system of the invention. While a profile like a saw having almost equal angles are seen here, this is not obligatory. There may be a triangular, rectangular, or trapezoid, or even an inclined profile with any angle. The jaw recessed connection surface (8) and the shoe recessed connection surface (9) should have similar profiles so as to correspond to each other. An overlapping profile is not necessary at every location, it is sufficient to have the overlapping profile mostly. The characteristic features of the arrangement are that the jaw recessed connection surface (8) comprises at least one jaw apex (8*a*) and at least one jaw cavity (8*b*), similarly the shoe recessed connection surface (9) comprises at least one shoe apex (9*a*) and at least one shoe cavity (9*b*). Another characteristic feature is that said jaw apex (8*a*) corresponds to said shoe cavity (9*b*) and said shoe apex (9*a*) correspond to said jaw cavity (8*b*) by an overlapping manner. The pressure force (F1) herein which is the force produced in the pile driving system and introduced to the jaws (6) and subsequently to the shoes (7) is will encounter a reaction force (F2) created by the ground. The locations bearing these forces are the connection areas, i.e. the jaw apex (8*a*), shoe cavity (9*b*), shoe apex (9*a*), and the jaw cavity (8*b*), while there used to be present a plurality of attachment pins in an adequate number and having the adequate thickness which encounter these forces in the prior art. In other words, these forces will be like the pressure force (F1') on the teeth and the reaction force (F2') on the teeth. The combining force (F3) which is the force combining the jaw (6) and the shoe (7) is small or small enough to be negligible relative to the pressure force (F1) and the reaction force (F2). This force is provided by the wedge stabilizing element (10) entering the gap (6*c*) and the securing wedge (11) being inserted into the wedge compression housing (10*a*). Thus, there will be no need for the complex systems leading to difficulties in the assembly which are formed to maintain the jaws (6) and shoes (7) rigidly attached so as to resist to the high vibration pressure forces, which is a significant problem in the prior art.

INDUSTRIAL APPLICABILITY OF THE INVENTION

The pile driving system of the invention may be basically attached to the construction equipment and hydraulically controlled. However, it may also comprise mechanic or hybrid systems if desired. The main objective of these systems is that the jaws (6) move the arms (6) so as to be closer and move away from each other. The system in which the assembly and disassembly of the shoes on the jaws (6) are easy as stated above may be provided through the wedge or other systems such that it comprises the connection surfaces (8, 9). The system of the invention will be possibly applied on the independent pile driving machines or the construction equipment.

The invention claimed is:

1. A pile driving system for use with a piece of construction equipment, the pile driving system comprising:

a body having a pair of arms, at least one of the pair of arms being movable, each of the pair of arms having a jaw at an end thereof, the jaw having a jaw recessed connection surface formed at an inner portion of the jaw and at least one shoe, the at least one shoe having a shoe recessed connection surface overlapping the jaw recessed connection surface;

a body connection arrangement connected to said body and adapted to connect said body to the piece of construction equipment;

a wedge stabilizing element located on the at least one shoe so as to rigidly connect the jaw and the at least one shoe together, the jaw having at least one gap that receives said wedge stabilizing element; and a securing wedge cooperative with said wedge stabilizing element so as to rigidify the connection of said wedge stabilizing element with the at least one gap in the jaw.

2. The pile driving system of claim 1, the at least one gap being a wedge hole, the pile driving system further comprising:

a wedge bearing on the jaw so as to allow said securing wedge to be attached to and detached from the jaw.

3. The pile driving system of claim 1, wherein said wedge stabilizing element tightly connects the at least one shoe to the jaw and connects the jaw recessed connection surface to the shoe recessed connection surface to each other in an overlapping arrangement.

4. The pile driving system of claim 1, wherein the jaw recessed connection surface and the shoe recessed connection surface have profiles symmetrical to each other.

5. The pile driving system of claim 4, wherein the jaw recessed connection surface and the shoe recessed connection surface are triangular recesses.

6. The pile driving system of claim 1, further comprising:

a mounting protrusion located on the jaw; and a mounting housing positioned on the at least one shoe, said mounting housing receiving said mounting protrusion therein.

7. The pile driving system of claim 1, wherein a mounting protrusion is on the at least one shoe and a mounting housing is on the jaw.

8. The pile driving system of claim 1, wherein said securing wedge has a conical shape.

9. The pile driving system of claim 1, wherein the at least one shoe and the jaw are combined on the jaw recessed connection surface and the shoe recessed connection surface so as to be rigid when said wedge stabilizing element enters the at least one gap and said securing wedge is inserted into a wedge compression housing.

* * * * *